US006257787B1

(12) United States Patent
Kirk

(10) Patent No.: US 6,257,787 B1
(45) Date of Patent: Jul. 10, 2001

(54) BALL POINT PEN SMOOTH TOUCH

(76) Inventor: Norbert Kirk, 307 W. Wood Dr., Phoenix, AZ (US) 85029

( * ) Notice: Subject to any disclaimer, the term of this patent is extended or adjusted under 35 U.S.C. 154(b) by 0 days.

(21) Appl. No.: 09/604,806

(22) Filed: Jun. 28, 2000

(51) Int. Cl.[7] ..... B43K 24/00; B43K 7/00
(52) U.S. Cl. ..... 401/104; 401/111; 401/112
(58) Field of Search ..... 401/104–106, 401/109–114

(56) References Cited

U.S. PATENT DOCUMENTS

| | | | | |
|---|---|---|---|---|
| 2,500,979 | * | 3/1950 | Coler-Dark | 401/114 |
| 3,146,758 | * | 9/1964 | Zepell | 401/106 |
| 3,291,101 | * | 12/1966 | Helitas | 401/110 |
| 3,334,615 | * | 8/1967 | Bross | 401/110 |
| 3,419,336 | | 12/1968 | Kirk . | |
| 3,819,282 | * | 6/1974 | Schultz | 401/105 |
| 5,263,786 | * | 11/1993 | Kageyama | 401/111 |
| 5,570,965 | * | 11/1996 | Coolen | 401/104 X |

* cited by examiner

*Primary Examiner*—Steven O. Douglas
*Assistant Examiner*—Kathleen J. Prunner
(74) *Attorney, Agent, or Firm*—George H. Miller Jr., Atty.

(57) ABSTRACT

A tubular cap for the top of a ball point pen, the cap having a long slot with an offset defining a lower long slot and an upper long slot with narrow slots perpendicular to the upper long slot and extending on either side of the long slot, the top of the cap supporting an internal coil spring extending down the cap toward the open end of the long slot, the coil spring engaged with the plunger of the ball point pen short of full extension of the ink cartridge housed therein and providing a smooth touch while writing that can be adjusted for firm, medium and soft touch writing.

6 Claims, 1 Drawing Sheet

BALL POINT PEN SMOOTH TOUCH

BACKGROUND OF THE INVENTION

The art of writing with ink has gone through many changes over the centuries. Quill pens used the hollow roots of bird feathers to convey ink to paper. Then came pens with refillable rubber cartridges to convey the ink to a flexible metal tip with a slight hole and split in the middle to convey the ink to paper. Both quill pens and metal tip pens had a degree of springiness and flexibility that made pen writing a smooth experience.

In the late 1940's, ball point pens were invented and since then have come to dominate the ink pen market. They are compact, convenient and always ready to use. With just a push down on a spring biased finger actuating plunger at the top, the tip emerges with the ball point and you can begin writing. The ink is contained in a rigid cartridge and has a certain consistency that permits it to be fed to the tip at the required rate to convey it to the paper. Admittedly, with all the required forms to be filled out in today's society, sometimes forms with three or four carbons attached, that rigid cartridge can be pushed on by a force that could not be applied to a quill or standard metal tip pen.

However, there were many persons who appreciated good penmanship and those practitioners enjoyed the touch of a slightly springy tip that conveyed liquid ink to paper and permitted the hand to use a relaxed grip with a cushioned writing action. The dominance of the market by ball point pens has made the availability of cushioned writing action more difficult.

In 1968, Norbert A. Kirk received U.S. Pat. No. 3,419,336, incorporated herein by reference, which was an effort to provide a springy cushioned ball point pen. Between the spring biased finger actuating piece at the top and the rigid ink cartridge that was projected out of the pen housing, Kirk had an intervening coil spring that was tied to a peg on the actuating piece and to a peg on the ink cartridge. Lineal force on the ink tip was cushioned by that spring and you could use a relaxed grip with a cushioned writing action.

It is an object of this invention to provide a springy type support to the writing tip of ball point pens.

It is a further object of this invention to provide a springy type support to the writing tip of ball point pens by external means, i.e. outside the housing of the ink pen cartridge and the surrounding cylinder.

It is a further object of this invention to provide a springy type support that may be transferred from one ball point pen to another ball point pen, i.e. applied to one pen, removed therefrom and applied to another pen for use.

SUMMARY OF THE INVENTION

The above stated and related objects are achieved by having a cap for the ball point pen that cooperates with the spring biased plunger and the clip on the pen barrel to provide a spring within the cap to keep the ball point tip out of the barrel for writing but not extended far enough out of the barrel to be locked into place. The tip has a springiness based upon the spring in the cap that provides a smooth writing experience.

DETAILED DESCRIPTION OF THE INVENTION

Figure 1:
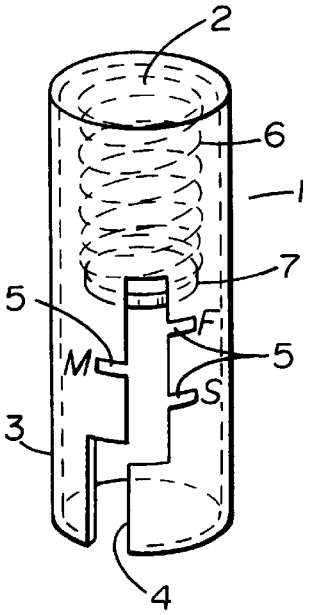
FIG. 1 is a perspective view of a tubular cap for a ball point pen.

FIG. 1 shows cap 1 with top 2 and tubular portion 3 with long slot 4 with a circumferential offset at 15 (the offset equal to the width of a pocket clip and perhaps 1/16 of an inch more) to form a lower long slot and an upper long slot and narrow slots 5 spaced above the offset. The upper narrow slot is for firm (F) touch writing, the middle narrow slot is for medium (M) touch writing and the lower slot is for soft (S) touch writing. Within cap 1 is mounted a spring 6 with an end plug 7 or other type of element, e.g. cup shaped, to make contact with a ball point pen plunger. The long slot 4 and narrow slots 5 each have a width slightly more than the width of a clip on a ball point pen. The offset 15 with the pocket clip 14 keeps the cap 1 on the pen without the pocket clip 14 being in one of the three narrow slots above the offset when the pen is not being used.

Figure 2:
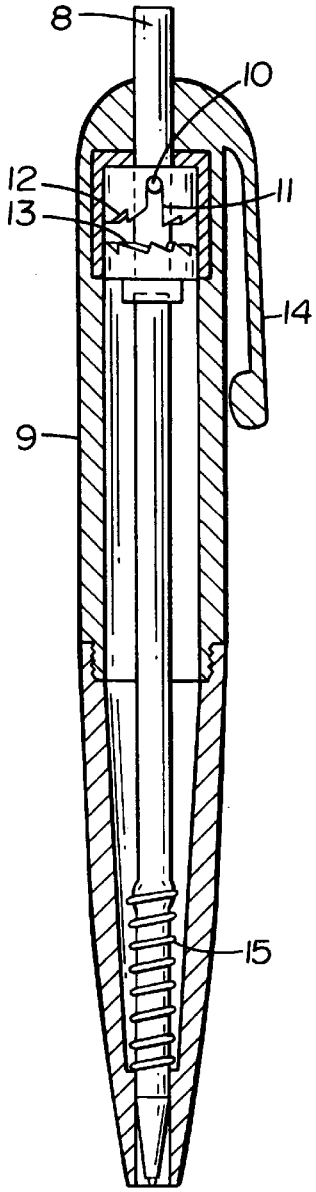
FIG. 2 (PRIOR ART)
FIG. 2 is a conventional ball point pen with the pen in the retracted position.

FIG. 2 is a view of a conventional ball point pen in the retracted position with plunger 8 fully extended out of the barrel 9 and plunger pin 10 at the top of deep slot 11 and the writing tip fully retracted. The ink barrel is biased upwardly by spring 15. When plunger 8 is fully pushed in, teeth on interfacing upper cam teeth 12 and lower cam teeth 13 will rotate and pin 10 will rotate and be in between two of the upper cam teeth 12 and the writing tip will be fully extended. When plunger 8 is pushed in a second time, the pin 10 will be rotated back to slide up deep slot 11 to retract the writing tip. The pen has a pocket clip 14 that lies along the upper barrel and has a transition to the top of the pen. This transition portion is the point that interfaces with the narrow slots 5 in the cap 1.

In operation of the invention, with the pen as shown in FIG. 2, cap 1 is placed over the top of the pen and clip 14 is located in the lower portion of long slot 4 at the offset and plug 7 is in contact with the upper surface of plunger 8. The cap is rotated to the upper portion of the long slot and pushed down on the outer pen housing until the writing tip starts to protrude to a desired length and the cap is rotated until the clip 14 is secured in one of the narrow slots 5. The pen is then ready for writing. The lower spring 15 in the barrel has prevented the tip from being fully extended and spring 6 in the cap will permit the tip to move up and down with the plunger pin 10 riding up and down a short distance in deep slot 11, a distance that is controlled by the cap spring 6.

Figure 3:
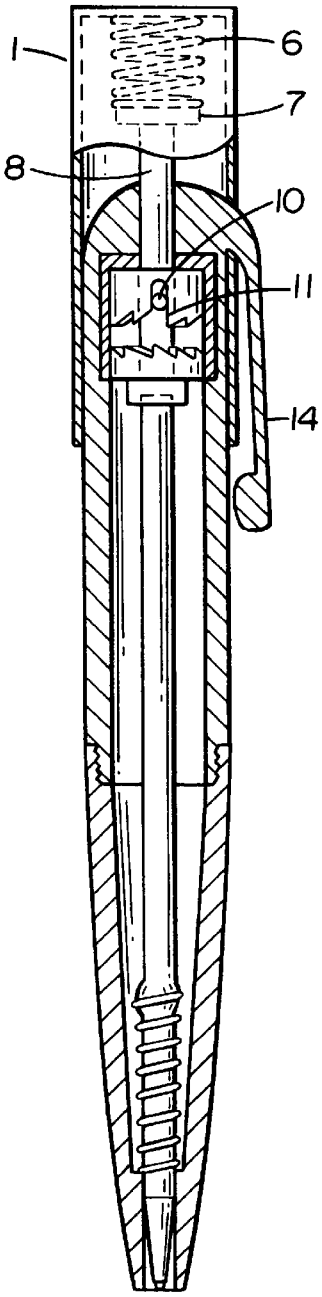
FIG. 3 is a side view of the cap on the pen with the spring in the cap in contact with the plunger.
Figure 4:
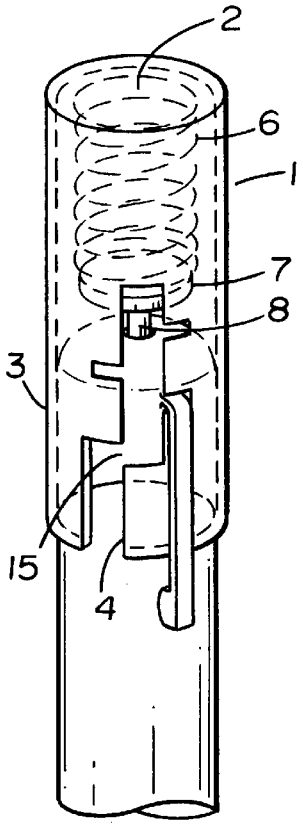
FIG. 4 is a perspective view of the cap on the pen.

FIG. 3 shows the cap 1 mounted on the top of the pen with the clip 14 extending through one of the slots 5 to fix the position of the cap with respect to the plunger 8.

The number of narrow slots 5 can be varied and they may be on a single side. However, staggering the narrow slots on each side increases the distance between the slots and results in a stronger and more durable cap.

Caps with various strength springs can be made of various diameters with slots of different width and slots with different spacing and packaged in a variety of ten to provide versatility in having a cap to fit virtually any ball point pen.

Having described the preferred embodiment and obvious modifications of it, there may be other modifications that are obvious and are also intended to be covered by this disclosure.

What is claimed is:

1. A tubular cap for the top of a ball point pen, the cap comprising a tubular wall portion having a long slot formed in the wall portion, the long slot being open at one end with an intermediate offset that defines a lower long slot and an upper long slot, the upper long slot extending along a length up the tubular wall portion and being provided with spaced apart narrow slots perpendicular to the upper long slot and extending on either side of the upper long slot, the top of the tubular wall portion being closed and supporting an internal coil spring extending down inside the tubular wall portion toward the open end of the long slot, the coil spring having a plug adapted to engage a finger actuating plunger on the top of the ball point pen.

2. A tubular cap for the top of a ball point pen as in claim 1, wherein the long slot and narrow slots each have a width at least as wide as a clip member adapted to be mounted on the top of the ball point pen.

3. A tubular cap for the top of a ball point pen as in claim 2, wherein a lower part of the long slot is adapted to be positioned over the top of the ball point pen such that the clip member extends out of the long slot with the clip member located at the offset.

4. A tubular cap for the top of a ball point pen as in claim 3, wherein the cap is adapted to be rotated such that the clip member is aligned with the upper long slot and then pushed onto the pen to a selected position and then cap rotated to secure the clip member in one of the narrow slots on either side of the long slot.

5. A tubular cap for the top of a ball point pen as in claim 4, wherein the narrow slots are spaced from one another such that three degrees of touch are provided comprising firm, medium and soft.

6. A tubular cap for the top of a ball point pen as in claim 1, wherein the plug is cup shaped and adapted to enclose an end of the plunger.

* * * * *